US010316377B2

(12) United States Patent
Kamimura et al.

(10) Patent No.: US 10,316,377 B2
(45) Date of Patent: Jun. 11, 2019

(54) PRODUCTION METHOD FOR MARAGING STEEL AND PRODUCTION METHOD FOR MARAGING STEEL CONSUMABLE ELECTRODE

(71) Applicant: HITACHI METALS, LTD., Tokyo (JP)

(72) Inventors: Takahiko Kamimura, Yasugi (JP); Yuuichi Hadano, Yasugi (JP); Kenta Imazeki, Yasugi (JP); Katsuhiko Ohishi, Yasugi (JP)

(73) Assignee: HITACHI METALS, LTD., Tokyo (JP)

( * ) Notice: Subject to any disclaimer, the term of this patent is extended or adjusted under 35 U.S.C. 154(b) by 117 days.

(21) Appl. No.: 15/325,561

(22) PCT Filed: Jul. 15, 2015

(86) PCT No.: PCT/JP2015/070268
§ 371 (c)(1),
(2) Date: Jan. 11, 2017

(87) PCT Pub. No.: WO2016/010073
PCT Pub. Date: Jan. 21, 2016

(65) Prior Publication Data

US 2017/0159140 A1 Jun. 8, 2017

(30) Foreign Application Priority Data

Jul. 16, 2014 (JP) ..... 2014-145865

(51) Int. Cl.
*C21C 7/00* (2006.01)
*C21C 7/04* (2006.01)
(Continued)

(52) U.S. Cl.
CPC ..... *C21C 7/0006* (2013.01); *C21C 5/5229* (2013.01); *C21C 7/00* (2013.01);
(Continued)

(58) Field of Classification Search
CPC .. C21C 7/006; C21C 7/04; C21C 7/06; C22B 9/20; C22B 9/04; C22C 33/04; C22C 38/002
See application file for complete search history.

(56) References Cited

U.S. PATENT DOCUMENTS 7,597,737 B2 * 10/2009 Hara ..... C21C 7/0006 75/10.64
2004/0093983 A1 5/2004 Mishima et al.
2015/0044087 A1 * 2/2015 Ayabe ..... C21C 7/04 420/91

FOREIGN PATENT DOCUMENTS

EP 1422301 A1 5/2004
EP 1679384 A1 7/2006
(Continued)

OTHER PUBLICATIONS

Family list for 2015044087 A1 including WO 2013146689 A1 (Year: 2013).*
(Continued)

*Primary Examiner* — Tima M McGuthry-Banks
(74) *Attorney, Agent, or Firm* — Sughrue Mion, PLLC

(57) ABSTRACT

The invention provides a maraging steel production method in which an oxide is added during an Mg oxide formation step, the production method including: the Mg oxide formation step in which Mg is added to molten steel and MgO is formed in the molten steel, during primary melting; a consumable electrode production step in which, after the Mg oxide formation step, the molten steel is solidified and a consumable electrode having residual MgO is obtained; and
(Continued)

a vacuum arc re-melting step in which the consumable electrode is used and vacuum arc re-melting is performed.

5 Claims, 1 Drawing Sheet

(51) Int. Cl.

| | |
|---|---|
| ***C21C 7/06*** | (2006.01) |
| ***C22B 9/20*** | (2006.01) |
| ***C22C 9/04*** | (2006.01) |
| ***C22C 33/04*** | (2006.01) |
| ***C22C 38/00*** | (2006.01) |
| ***C21C 5/52*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |

(52) U.S. Cl.
CPC ..... *C21C 7/04* (2013.01); *C21C 7/06* (2013.01); *C22B 9/20* (2013.01); *C22C 9/04* (2013.01); *C22C 33/04* (2013.01); *C22C 38/002* (2013.01); *C22C 38/06* (2013.01); *C22C 38/105* (2013.01); *C22C 38/12* (2013.01); *C22C 38/14* (2013.01)

(56) References Cited

FOREIGN PATENT DOCUMENTS

| | | | |
|---|---|---|---|
| JP | 54-031017 | A | 3/1979 |
| JP | 2001214212 | A | 8/2001 |
| JP | 2003183765 | A | 7/2003 |
| JP | 2004-183097 | A | 7/2004 |
| JP | 2004-256909 | A | 9/2004 |
| JP | 2005232551 | A | 9/2005 |
| JP | 2005248187 | A | 9/2005 |
| WO | 2005/035798 | A1 | 4/2005 |

OTHER PUBLICATIONS

Quatravaux, T. et al. "Transient VAR Ingot Growth Modelling: Application to Specialty Steels." Proceedings of the 2003 International Symposium on Liquid Metals. Journal of Materials Science. vol. 39, pp. 7183-7191. (Year: 2004).*

Communication dated Feb. 7, 2018, from the State Intellectual Property Office of People's Republic of China in counterpart Application No. 201580038485.6.

Communication dated Dec. 19, 2017 from the European Patent Office in counterpart European application No. 15822754.6.

International Search Report of PCT/JP2015/070268, dated Sep. 29, 2015. [PCT/ISA/210].

* cited by examiner

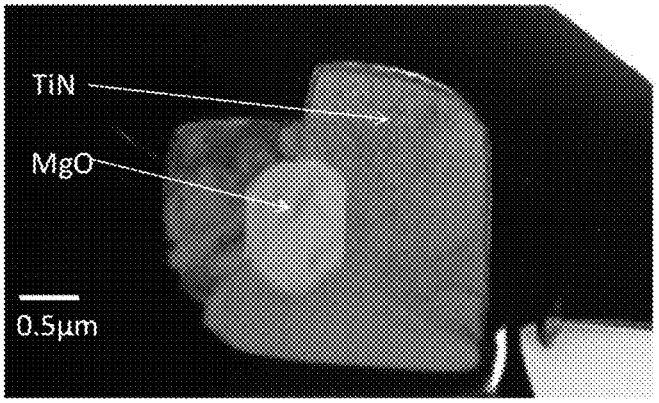
TiN
MgO
0.5μm

PRODUCTION METHOD FOR MARAGING STEEL AND PRODUCTION METHOD FOR MARAGING STEEL CONSUMABLE ELECTRODE

CROSS REFERENCE TO RELATED APPLICATIONS

This application is a National Stage of International Application No. PCT/JP2015/070268filed Jul. 15, 20151 (claiming priority based on Japanese Patent Application No. 2014-145865filed Jul. 16, 2014), the contents of which are incorporated herein by reference in their entirety.

TECHNICAL FIELD

The invention relates to a method for producing a maraging steel and a method for producing a consumable electrode of the maraging steel.

BACKGROUND ART

A maraging steel has a very high tensile strength of around 2000 MPa and is therefore used for various applications such as an component requiring a high strength, for example, a rocket part, a centrifuge part, an aircraft part, a part for a continuously variable transmission of an automobile engine, or a die or the like.

The maraging steel usually includes an appropriate amount of molybdenum and titanium as a strengthening element, and can obtain a high strength by precipitating an intermetallic compound such as $Ni_3Mo$, $Ni_3Ti$ or $Fe_2Mo$ through an aging treatment. A representative composition of the maraging steel including molybdenum and titanium is, by mass %, Fe-18%Ni-8%Co-5%Mo-0.45%Ti-0.1%Al.

Although the maraging steel can obtain a very high tensile strength, it includes a nonmetallic inclusion (hereinafter, referred to as merely "inclusion") in the steel, such as a nitride or a carbonitride such as TiN or TiCN, or an oxide such as $Al_2O_3$ or $Al_2O_3$—MgO. Thus, fatigue failure may occur starting from a coarse inclusion in the steel.

Therefore, it has been proposed to improve a fatigue strength by making TiN or TiCN fine. The Applicant has proposed, for example in JP 2004-256909 A (Patent Literature 1) and WO 2005/035798 (Patent Literature 2), a method for making a nitride based inclusion such as TiN or TiCN fine by remelting a consumable electrode including magnesium by a vacuum arc remelting (hereinafter, referred to as "VAR") process .

CITATION LIST

Patent Literature

PATENT LITERATURE 1: JP-A-2004-256909
PATENT LITERATURE 2: WO 2005/035798 A

SUMMARY OF INVENTION

Technical Problem

In the method for making the TiN or TiCN inclusion fine disclosed in Patent Literatures 1 and 2, an amount of magnesium is intentionally added in a primary vacuum melting process to form MgO in a consumable electrode in advance, so that the consumable electrode including the nitride based inclusion such as TiN and TiCN which encompasses MgO as a nucleus is produced. In the subsequent VAR process, the nitride based inclusions such as TiN or TiCN are facilitated to decompose pyrolytically, so that the nitride based inclusions becomes fine.

The method for producing the maraging steel in Patent Literatures 1 and 2 employ a combination of production step of the consumable electrode including TiN or TiCN with a MgO nucleus and the subsequent VAR process in order to make the nitride based inclusions fine. The method is based on a technical idea that a harmful oxide inclusion is intentionally formed to utilize the oxide inclusion for making the nitride based inclusions fine, and it was a novel and original method. The nitride based inclusion in the maraging steel obtained by the method can have significantly small size.

Even in the method by adding magnesium, such nitride based inclusion as does not include the MgO nucleus may be present at a certain percentage. It has been found that the nitride based inclusion without the MgO nucleus grows to a much larger size after the remelting step than that of the nitride based inclusion with the MgO nucleus. Therefore, a method for making the nitride based inclusion including the MgO nucleus as much as possible in the primary vacuum melting process is desired to stably make the fine nitride based inclusion.

On the other hand, an effect of oxide can not be ignored in some cases after the remelting step when the steel ingot has a weight of not more than one ton. The oxide is usually removed by a floatation separation in a molten steel pool in the VAR process. However, the floatation separation effect of the oxide is reduced when the steel ingot is small, since the molten steel solidifies in a shorter time period. In addition, although the steel ingot obtained by the VAR process is subjected to hot and cold workings, in the course of which the oxide are crushed, this crushing effect is small since a reduction of thickness by the working is small in a case of the small ingot.

Thus, an object of the invention is to provide a method for producing a maraging steel, by which the MgO nucleus is surely formed in the primary melting process as well as the effect of the oxide is suppressed, thereby nitride based inclusion such as TiN or TiCN are surely made fine in the steel.

SOLUTION TO PROBLEM

The invention has been made to solve the above problem.

According to an aspect of the invention, provided is a method for producing a maraging steel, including a magnesium oxide formation step including adding an amount of magnesium into a molten steel in a primary vacuum melting process to form MgO in the molten steel;

a consumable electrode production step including solidifying the molten steel after the magnesium oxide formation to obtain a consumable electrode including MgO; and a vacuum arc remelting step including vacuum arc remelting with use of the consumable electrode, wherein the magnesium oxide formation step includes adding an amount of oxide having a higher standard free energy of formation than MgO.

According to an embodiment of the invention, a steel ingot produced in the vacuum arc remelting has a diameter of not less than 450 mm.

According to an embodiment of the invention, the maraging steel after the vacuum arc remelting comprises, by mass, not more than 0.1% of carbon;

0.01 to 1.7% of aluminum;

0.2 to 3.0% of titanium;

8 to 22% of nickel;

5 to 20% of cobalt;

2 to 9% of molybdenum;

not more than 0.0030% of magnesium, and the balance being iron and impurities.

According to an embodiment of the invention, the oxide is an oxide of iron, nickel, manganese, silicon, chromium, molybdenum and/or cobalt.

According to an embodiment invention, the amount of an oxide to be added is 0.01% to 1.0% of a weight of the molten steel.

According to an embodiment invention, the oxide is added within ten minutes after addition of magnesium.

According to an another aspect of the invention, provided is a method for producing a consumable electrode made of a maraging steel by vacuum melting, including:

a magnesium oxide formation step including adding an amount of magnesium into a molten steel in a primary vacuum melting process to form MgO in the molten steel; and a consumable electrode production step including solidifying the molten steel after the magnesium oxide formation step to obtain a consumable electrode including MgO, wherein the magnesium oxide formation step includes adding an amount of oxide having a higher standard free energy of formation than MgO.

According to the invention, a fine nitride based inclusion such as TiN or TiCN can be produced more surely and stably, and an effect of an oxide can be suppressed. Therefore, the maraging steel produced by the method of the invention has an excellent fatigue strength, and thus is suitable for an important component requiring a fatigue strength.

Other advantages, features, and details of the invention will be apparent from following the description of the non-limiting embodiment of the invention with attached drawings.

BRIEF DESCRIPTION OF DRAWINGS

FIG. 1 shows a cross-sectional electron micrograph of a nitride based inclusion including a MgO nucleus.

DESCRIPTION OF EMBODIMENTS

It is necessary to prepare a consumable electrode including a specified amount of magnesium to be used for a VAR process in order to produce a maraging steel of the invention. When the amount of magnesium is added intentionally during a producing of the consumable electrode, oxygen in a steel melt is combined with magnesium since magnesium has a high affinity to generate MgO. The generated MgO acts as a nucleus to form a titanium based inclusion in the consumable electrode. Since MgO has a less flocculation property, it disperses in the steel finely. Therefore, a titanium based inclusion having MgO as a nucleus is also finely dispersed.

As described above, it has been a problem that a nitride based inclusion having no MgO nucleus is formed during the primary vacuum melting process. It is considered that a probability of generation of the nitride based inclusion having no MgO nucleus increases if an amount of oxygen or oxide is small in the magnesium oxide formation step of the invention The nitride based inclusion without MgO nucleus easily becomes coarse. The coarse nitride based inclusion after the primary vacuum melting process further grows during remelting. The nitride based inclusion without MgO nucleus is hardly melted. Its main reason is supposed that a nitride based inclusion having a MgO nucleus easily melts due to a decomposition reaction of the nucleus. This reason is not clear, but, it is supposed that MgO causes a decomposition reaction:

$$MgO \rightarrow Mg+O$$

due to evaporation of magnesium from a surface of a molten steel during the subsequent VAR process. Alternatively, it is supposed that lattice mismatch between TiN and MgO nucleus causes a change of a melting point of TiN. In any case, it is considered that the decomposition reaction of the nucleus of the inclusion facilitates melting of the nitride based inclusion during the vacuum arc remelting process. Then, a nitride based inclusion without the nucleus is most disadvantageous to melting. This can be the reason why the nitride based inclusion without the nucleus grows in a process of vacuum melting/vacuum arc remelting process.

In view of the above, a sufficient amount of oxygen for forming MgO is surely supplied by adding an amount of oxide having a higher standard free energy of formation than magnesia (MgO) in the magnesium oxide formation step, thereby MgO can be formed surely during the primary vacuum melting process.

Specifically, an oxide having a higher standard free energy of formation than magnesia (MgO) is added in the magnesium oxide formation step during the primary vacuum melting process. While MgO is formed by addition of magnesium in the maraging steel of the invention, oxygen is also supplied from an oxide. Since the standard free energy of formation of the oxide is higher than that of magnesia (MgO), the oxide is reduced by magnesium, and thus magnesia (MgO) is produced. Preferable examples of the oxide include iron oxide (FeO, $Fe_2O_3$, $Fe_3O_4$), nickel oxide (NiO), manganese oxide (MnO, $Mn_2O_3$, $Mn_3O_4$, $Mn_2O_3$, $MnO_2$, $MnO_3$), silicon oxide ($SiO_2$), chromium oxide ($Cr_2O_3$), molybdenum oxide (MoO, $MoO_2$, $Mo_2O_3$, $Mo_3O_4$), and cobalt oxide (CoO, $Co_3O_4$). Although alumina ($Al_2O_3$) also has a higher standard free energy of formation than magnesia (MgO), it takes a long time to reduce magnesium since alumina is an stable oxide. Thus, alumina is preferably avoided. In addition, more preferable is such oxides as including a metal, such as iron, nickel, cobalt or molybdenum, which does not become an impurity when reduced. Although it might be think of to add MgO itself that becomes a nucleus of a TiN or TiCN nitride, it is difficult to prepare an extreme small MgO powder having a size of not larger than 1 μm that can become a nucleus of TiN or TiCN, or to add such a fine powder into the molten steel.

The oxide is added preferably just before or just after the addition of magnesium. In particular, the oxide is preferably added within 10 minutes after the addition of magnesium. This is because magnesium evaporates and disappears when the molten steel is held after the addition of magnesium. Therefore, it is desirable to add an oxide without delay after the addition of magnesium, and then cast the steel without delay. If the oxide is added before the addition of magnesium, slag may generate due to the oxide, which may inhibit the addition of magnesium itself.

An amount of the oxide to be added is preferably 0.01% to 1.0% of a weight of the molten steel. Even when the oxide is added to the molten steel, a part of the oxide becomes a slag on a surface of the molten steel, and thus all of the oxygen in the oxide is not used for forming MgO in the molten steel. Therefore, it is necessary to supply oxygen in a form of the oxide and in an amount that is more than required for forming the MgO oxide. Therefore, a lower limit of the amount of the oxide to be added is preferably 0.01%. On the contrary, if the oxide is excessively added, an amount of the oxide in the steel increases and also a large amount of slag is generated which causes a problem in an operation. Therefore, an upper limit of the amount of the oxide to be added is preferably 1.0%. The amount of the oxide is more preferably 0.05% to 0.30% of the weight of the molten steel.

Preferably, a pressure in a vacuum melting furnace is pressurized by introducing an inert gas such as Ar gas after the addition of magnesium. For example, the pressure after the addition of magnesium may be 1 to 60 kPa. Magnesium tends to evaporate from a surface of the molten steel after the addition of magnesium. If the pressure in the furnace is low, magnesium becomes a bubble and boils and evaporates from an inside of the molten steel as well as from the surface of the molten steel. The boiling phenomenon increases a surface area of the molten steel and increases an evaporation rate of magnesium significantly. Therefore, the pressure in the furnace is desirably pressurized so that the boiling does not occur.

It is preferable to control a oxygen content to 3 to 15 ppm in the electrode produced by the primary vacuum melting process in the above conditions. When the oxygen content is less than 3 ppm, formation of the oxide may be insufficient. When the content is more than 15 ppm, the oxide inclusion may grow largely.

In the invention, MgO is produced in the molten steel in the magnesium oxide formation step and a consumable electrode is produced by casting the molten steel including MgO in the consumable electrode production step. Then, a VAR process is conducted with use of the consumable electrode.

When the above consumable electrode is used in the VAR process, a volatile element Mg evaporates at a high temperature. Thus, the oxide based inclusion including MgO decomposes, and oxygen starts to diffuse into a gas phase and a liquid phase. That is, the decomposition of MgO facilitates reduction of the oxide. Since the nitride based inclusion such as TiN or TiCN in the consumable electrode includes MgO as a nucleus, pyrolysis of the titanium nitride based inclusion is promoted and as a result the titanium based inclusion is made fine.

Since an amount of the nitride based inclusion including the MgO nucleus is increased in the consumable electrode according to the invention, the pyrolysis is further surely facilitated to make the nitride based inclusion fine. A pressure during the VAR process is preferably reduced to lower than 0.6 kPa, more preferably not higher than 0.06 kPa. This is because a pressure higher than 0.6 kPa makes the progress of a decomposition reaction of MgO slow.

A steel ingot produced by the VAR process preferably has a diameter of not smaller than 450 mm. This this diameter is suitable for producing a large steel ingot of not less than 2 tons. Floating separation effect of an oxide becomes significant in the large steel ingot of not less than 2 tons.

Table 1 shows a minimum size of a diameter of an inclusion (oxide) which can be removed by the floatation separation effect in a case where an ingot is a VAR process steel ingot size. That is, an inclusion having a size not smaller than the minimum size can be removed. This removable minimum size of the inclusion (oxide) was calculated by a Stokes equation using a depth of a molten steel pool of the VAR process and inclusion floatation separation times depending on steel ingot diameters. The depth of the molten steel pool in the VAR process was calculated by a solidification analysis with use of a melting speed condition when the VAR process is stable in an actual melting. The inclusion floatation separation time was determined by dividing the depth of the molten steel pool in the VAR process by a growth rate of the steel ingot in the above stable condition. As seen from Table 1, the removable minimum size of the inclusion (oxide) becomes larger as the steel ingot diameter is smaller. Practically, a crushing effect of the oxide through a hot working step and a cold working step after the melting in the VAR process is also more advantageous when the steel ingot diameter is larger. It is desirable that the steel ingot diameter is larger as far as a size of a nitride/carbonitride is permissible. It is found that the oxide size is surely made not larger than 15 μm when the steel ingot diameter is not greater than 450 mm in the invention. Therefore, a larger steel ingot diameter is advantageous for the removal of the oxide inclusion.

TABLE 1

| | minimum size of removable inclusion (μm) | | |
|---|---|---|---|
| steel ingot diameter D (mm) | position in steel ingot diameter D/2 | position in steel ingot diameter 3D/8 | position in steel ingot diameter D/4 |
| φ350 | 12.6 | 13.9 | 13.4 |
| φ500 | 10.6 | 10.6 | 10.6 |
| φ600 | 8.8 | 8.8 | 8.8 |
| φ700 | 8.1 | 8.1 | 8.1 |
| φ800 | 7.2 | 7.2 | 7.2 |

It is preferable that the consumable electrode includes not less than 2 ppm of magnesium in order to form the above MgO. If the magnesium content is less than 2 ppm, the effects of reducing the inclusion and making them file can not be obtained significantly. Not less than 5 ppm of magnesium is desirably.

An upper limit of the magnesium concentration in the consumable electrode is 300 ppm in consideration of a toughness of the steel ingot or a product after remelting. When the concentration is 5 to 250 ppm, the above effects can be obtained more surely. Therefore, the upper limit is preferably 250 ppm.

However, since magnesium is volatile, addition of magnesium is not economic due to a low yield. Also, magnesium evaporates vigorously in the vacuum arc remelting, and thus the addition thereof forms an obstacle to the operation and also deteriorates a steel ingot surface. Therefore, the upper limit of the magnesium concentration is preferably 200 ppm. A more preferable range is 10 to 150 ppm. Please note that MgO decomposes into oxygen and magnesium gas during the vacuum arc remelting, and the content of magnesium is reduced to not more than 30 ppm after the vacuum arc remelting.

An amount of magnesium required for forming MgO can be added in a form of a magnesium alloy such as Ni—Mg or Fe—Mg as well as adding a magnesium metal directly in the molten steel. Above all, it is preferable to use a Ni—Mg alloy since it is easily handled and is easily adjustable for its content.

As described above, the method for producing a maraging steel of the invention is effective in making the nitride based inclusion such as TiN or TiCN fine. Therefore, the invention is particularly effective in the maraging steel to which titanium is intentionally added. Preferable composition of the maraging steel is as follows. Here, the composition is expressed by mass percent.

Titanium is an indispensable element since it forms a fine intermetallic compound through an aging treatment to contribute to precipitation strengthening. The titanium content is desirably not less than 0.2%. However, when the titanium content exceeds 3.0%, ductility and toughness are deteriorated. Therefore, the titanium content is preferably not more than 3.0%.

Nickel is an indispensable element to form a matrix structure having high toughness. When the nickel content is less than 8%, the toughness is deteriorated. On the other hand, an austenite phase is stabilized when the content is more than 22%, and it is difficult to transform into a martensitic structure. Therefore, the nickel content is preferably 8 to 22%.

Cobalt contributes to precipitation strengthening without significantly affecting stability of the matrix of a martensitic structure. Cobalt reduces a solubility of molybdenum and facilitates formation and precipitation of a fine intermetallic compound of molybdenum. When the cobalt content is less than 5%, the effect is not sufficiently obtained. When the content is more than 20%, the steel tends to become brittle. Therefore, the cobalt content is preferably 5 to 20%.

Molybdenum forms a fine intermetallic compound through an aging treatment and to contribute to strengthening by precipitating in a matrix. When the molybdenum content is less than 2%, the effect is small. When the content is more than 9%, a coarse precipitate tends to be generated to deteriorate ductility and toughness. Therefore, the molybdenum content is preferably 2 to 9%.

Aluminum contributes to strengthening by aging precipitation and also has a deoxidizing effect. Therefore, not less than 0.01% of aluminium is included in the steel. However, when the content is more than 1.7%, toughness is deteriorated. Therefore, the aluminum content is preferably not more than 1.7%.

Carbon forms a carbide or a carbonitride to reduce precipitation of an intermetallic compound, and thus reduces fatigue strength. Therefore, carbon may be limited not more than 0.1%.

The balance may be substantially iron. However, for example, boron is effective for grain refining and may be included in a range of not more than 0.01%s not to deteriorate toughness.

The steel includes inevitable impurity elements.

Oxygen forms an oxide and reduces fatigue strength of a product. However, as described above, oxygen compensates shortage of MgO as a nucleus of a nitride/carbonitride in an electrode. Since a sufficient amount of oxygen is required during the magnesium oxide formation step , the oxygen content in an electrode is set slightly higher, that is about 3 to 15 ppm. When an excessive amount of oxygen remains after the VAR process, the oxide may reduce fatigue strength. Therefore, the oxygen content in the steel ingot after the VAR process is preferably not more than 5 ppm.

Nitrogen forms a nitride or a carbonitride, and reduces fatigue strength. Therefore, the nitrogen content is preferably as low as possible, and an upper limit is preferably not more than 20 ppm.

The maraging steel described above is suitable, for example, for a power transmission belt of a motor vehicle, as a thin strip of not more than about 0.2 mm. In an application where a maraging steel having final thickness of not more than 0.5 mm is used, an oxide having a size of larger than e.g. 15 μm may possibly become a starting point of high cycle fatigue failure, and thus a size of the oxide in the material is preferably limited to not larger than 15 μm.

Typically, TiN exists in a maraging steel including titanium. TiN has a rectangular shape on which stress is likely to concentrate, and forms a hydrogen embrittlement region called a dark area. Thus, TiN is higher sensitive to high cycle fatigue failure than an oxide, and it is said that TiN in a material is typically required to have a size of not larger than 10 μm. Therefore, the maraging steel including titanium is one of preferable applications for applying the method of the invention.

EXAMPLES

Consumable electrodes were produced through a primary vacuum melting process, and a VAR process was conducted with use of the consumable electrodes to produce 2 tons maraging steel ingot. In Nos. 1 and 2 according to the invention, magnesium was added in a form of a Ni—Mg alloy during the primary vacuum melting process, and then nickel oxide was added to a molten steel. After confirming that nickel oxide melted, an argon gas was introduced in the melt and the molten steel was cast. The added amount of nickel oxide was 0.15% of a weight of the molten steel for No. 1, and 0.24% of a weight of the molten steel for No. 2. In Comparative Examples Nos. 11 and 12, nickel oxide was not added before cast.

The VAR process was conducted with use of the above consumable electrodes. A same mold was used for a VAR mold, and the electrodes were melt at a vacuum of 1.3 Pa and supplied current was 6.5 kA at a steady portion of the ingot. The obtained ingot by the VAR process had a diameter of 500 mm to efficiently remove a coarse oxide inclusion. Table 2 indicates chemical compositions.

TABLE 2

| | | composition (mass %, [ ]: ppm) | | | | | | | | | | |
|---|---|---|---|---|---|---|---|---|---|---|---|---|
| No. | state | C | Al | Si | Mn | Ti | Ni | Co | Mo | [Mg] | [O] | [N] |
| No. 1 | electrode | 0.0050 | 0.12 | <0.01 | 0.01 | 0.46 | 18.59 | 9.32 | 5.01 | 11 | 4.0 | 9.0 |
| | steel ingot | 0.0053 | 0.12 | 0.007 | 0.01 | 0.47 | 18.63 | 9.31 | 5.04 | 1 | 2.5 | 5.9 |
| No. 2 | electrode | 0.0050 | 0.10 | 0.01 | 0.01 | 0.45 | 18.52 | 9.30 | 5.00 | 3 | 3.0 | 7.6 |
| | steel ingot | 0.0051 | 0.08 | 0.006 | 0.01 | 0.46 | 18.59 | 9.31 | 5.04 | 1 | 2.1 | 5.9 |
| No. 11 | electrode | 0.0048 | 0.10 | 0.010 | 0.02 | 0.49 | 18.66 | 9.27 | 5.05 | 86 | 2.0 | 7.9 |
| | steel ingot | 0.0049 | 0.10 | 0.001 | 0.01 | 0.49 | 18.65 | 9.28 | 5.05 | 1 | 1.6 | 5.6 |
| No. 12 | electrode | 0.0050 | 0.11 | 0.011 | 0.01 | 0.49 | 18.60 | 9.26 | 5.07 | 24 | 2.2 | 7.6 |
| | steel ingot | 0.0051 | 0.11 | 0.007 | 0.01 | 0.49 | 18.59 | 9.24 | 5.07 | 1 | 2.2 | 5.3 |

The steel ingot obtained by the VAR process was subjected to soaking at 1250° C. for 20 hours, then subjected to hot rolling, a solution heat treatment at 820° C. for one hour, cold rolling, a solution heat treatment at 820° C. for one hour, and an aging treatment at 480° C. for 5 hours to produce a maraging steel strip having a thickness of 0.5 mm.

From both ends of each of the maraging steel strips Examples Nos. 1 and 2 of the invention and Comparative Examples Nos. 11 and 12, samples of 5 grams were taken cross-sectionally. Surfaces of the samples were cleaned by organic solvent. Each sample was dissolved in a solution which is a mixture of hydrochloric acid, nitric acid and water at a ratio of 1:1:2. Thereafter, the solution was filtered with a filter having a filtration diameter of 3μm to extract a nitride/carbonitride. 20 fields of view (one field of view has an area of about 0.04 $mm^2$) of the filter filtration surface were randomly observed with a scanning electron microscope (SEM). A maximum size of observed nitride/carbonitride in each field of view was recorded. A length of a long side and a width of a short side of the maximum nitride/carbonitride were measured to determine its area to calculate a circle-equivalent diameter. Circle-equivalent diameters from the 20 fields were analyzed by an extreme value statistical method to determine a maximum size of a nitride/carbonitride in one coil. The circle-equivalent diameter may be also determined from an image processing. Table 3 indicates the results thereof.

FIG. 1 illustrates a representative cross-sectional electron micrograph of a titanium nitride based inclusion taken from the electrode No. 1. FIG. 1 shows that TiN has a nucleus of MgO therein.

TABLE 3

| No. | maximum size of nitride based inclusion (μm) | note |
|---|---|---|
| No. 1 | 7.522 | the invention |
| No. 2 | 8.440 | the invention |
| No. 11 | 10.625 | Comparative Example |
| No. 12 | 12.125 | Comparative Example |

From Table 3, it is seen that a maximum size of a nitride based inclusion in a thin plate obtained by the method of the invention is so fine as not larger than 9 μm. That is, the size of the nitride based inclusion in the steel according to the invention is apparently finer than that of the steel according to Comparative Examples which has a size of larger than 10 μm. Also, an oxide based inclusion in each of Nos. 1 and 2 was examined with SEM. It was found that a maximum size thereof was 3.5 μm. This is due to an effect of increasing a diameter of a steel ingot.

The above extracting of the nitride/carbonitride was applied to samples taken from the electrodes before the VAR process. The filter after extraction was analyzed with an electron probe micro analyzer (EPMA) to observe whether a magnesium nucleus exits in the nitride/carbonitride remaining on the filter. The nitride/carbonitride was analyzed with an X-ray analyzer of EPMA with an acceleration voltage of 15 kV. Presence of the MgO nucleus was evaluated by detection of a magnesium peak. The nitride/carbonitride in which a magnesium peak was detected and on a surface of which a hole an oxide had been peeled off was observed were deemed as having the MgO nucleus, and a value obtained by dividing a total number of the nitride/carbonitride including the MgO nucleus by a total number of the nitride/carbonitride in the field of view was regarded as a ratio of the nitride/carbonitride including MgO nucleus. Table 4 indicates the results. It is found that a sample obtained from the electrodes according to the invention apparently has a higher ratio of the nitride/carbonitride including MgO nucleus.

TABLE 4

| No. | state | MgO nucleus holding ratio (%) | maximum size of nitride based inclusion (μm) | Note |
|---|---|---|---|---|
| No. 1 | electrode | 66.4 | 6.324 | the invention |
| No. 2 | electrode | 76.8 | 6.433 | the invention |
| No. 11 | electrode | 34.2 | 7.434 | Comparative Example |
| No. 12 | electrode | 34.0 | 7.915 | Comparative Example |

From Table 4, it is seen that samples obtained by the method according to the invention has a ratio of the nitride/carbonitride including MgO of not lower than 60% and is apparent higher. The size of the inclusion is as fine as not larger than 7 μm. It is also found that the maximum size of nitride based inclusion of Comparative Examples grew after the VAR process from that in the electrode before the VAR process in Table 4, while the size of the inclusion according to the invention is hardly changed.

From the above, it is apparent that the method of the invention can make the size of a nitride based inclusion such as TiN or TiCN fine more surely and a coarse oxide can be suppressed.

The invention claimed is:

1. A method for producing a maraging steel, comprising:

a magnesium oxide formation step including adding an amount of magnesium into a molten steel in a primary vacuum melting process to form MgO in the molten steel;

a consumable electrode production step including solidifying the molten steel after the magnesium oxide formation step to obtain a consumable electrode including MgO; and a vacuum arc remelting step including vacuum arc remelting with use of the consumable electrode to produce a maraging steel, wherein the magnesium oxide formation step includes adding an amount of an oxide having a higher standard free energy of formation than MgO; and wherein the maraging steel after the vacuum arc remelting comprises, by mass, not more than 0.1% of carbon;

0.01 to 1.7% of aluminum;

0.2 to 3.0% of titanium;

8 to 22% of nickel;

5 to 20% of cobalt;

2 to 9% of molybdenum;

not more than 0.0030% of magnesium, and the balance being iron and impurities.

2. The method according to claim 1, wherein a steel ingot produced in the vacuum arc remelting has a diameter of not less than 450 mm.

3. The method according to claim 1, wherein the oxide is an oxide of iron, nickel, manganese, silicon, chromium, molybdenum and/or cobalt.

4. The method according to claim 1, wherein the amount of the oxide to be added is 0.01% to 1.0% of a weight of the molten steel.

5. The method according to claim 1, wherein the oxide is added within ten minutes after the addition of magnesium.

* * * * *